United States Patent [19]

McKenzie

[11] Patent Number: 4,784,706

[45] Date of Patent: Nov. 15, 1988

[54] EMULSION EXPLOSIVE CONTAINING PHENOLIC EMULSIFIER DERIVATIVE

[75] Inventor: Lee F. McKenzie, Riverton, Utah

[73] Assignee: IRECO Incorporated, Salt Lake City, Utah

[21] Appl. No.: 128,098

[22] Filed: Dec. 3, 1987

[51] Int. Cl.[4] ..... C06B 45/00

[52] U.S. Cl. ..... 149/2; 149/46; 149/61; 149/83

[58] Field of Search ..... 149/2, 46, 61, 83

[56] References Cited

U.S. PATENT DOCUMENTS

| | | | |
|---|---|---|---|
| 4,357,184 | 11/1982 | Binet et al. | 149/2 |
| 4,543,136 | 9/1985 | Edamura et al. | 149/2 |
| 4,543,137 | 9/1985 | Edamura et al. | 149/2 |
| 4,548,660 | 10/1985 | Ikeda et al. | 149/2 |
| 4,698,105 | 10/1987 | Inoue et al. | 149/2 |
| 4,708,753 | 11/1987 | Forsberg | 149/38 |

*Primary Examiner*—Stephen J. Lechert, Jr.

[57] ABSTRACT

The invention relates to a water-in-oil emulsion explosive comprising a water-immiscible organic fuel as a continuous phase; an emulsified aqueous inorganic oxidizer salt solution as a discontinuous phase; and a phenolic derivative of polypropene or polybutene as an emulsifier.

8 Claims, No Drawings

EMULSION EXPLOSIVE CONTAINING PHENOLIC EMULSIFIER DERIVATIVE

The present invention relates to an improved explosive composition. More particularly, the invention relates to a water-in-oil emulsion explosive having improved stability and a lower viscosity. The term "water-in-oil" means a dispersion of droplets of an aqueous solution or water-miscible melt (the discontinuous phase) in an oil or water-immiscible organic substance (the continuous phase). The term "explosive" means both cap-sensitive explosives and noncap-sensitive explosives commonly referred to as blasting agents. The water-in-oil emulsion explosives of this invention contain a water-immiscible organic fuel as the continuous phase and an emulsified inorganic oxidizer salt solution or melt as the discontinuous phase. (The terms "solution" or "melt" hereafter shall be used interchangeably.) These oxidizer and fuel phases react with one another upon initiation by a blasting cap and/or a booster to produce an effective detonation. The explosives contain a phenolic derivative of polypropene or polybutene (hereafter referred to as a "phenolic derivative") as a water-in-oil emulsifier.

BACKGROUND OF THE INVENTION

Water-in-oil emulsion explosives are well-known in the art. See, for example, U.S. Pat. Nos. 4,356,044; 4,322,258; 4,141,767; 3,447,978 and 3,161,551. Emulsion explosives are found to have certain advantages over conventional aqueous slurry explosives, which have a continuous aqueous phase, as described in U.S. Pat. No. 4,141,767.

An inherent problem with emulsion explosives, however, is their relative instability, due to the fact that they comprise a thermodynamically unstable dispersion of supercooled solution or melt droplets in an oil-continuous phase. If the emulsion remains stable, these supercooled droplets are prevented from crystallizing or solidifying into a lower energy state. If the emulsion weakens or becomes unstable, however, then crystallization or solidification of the droplets results, and the explosive generally loses some of its sensitivity to detonation and becomes too viscous to handle for certain blasting applications. Moreover, it is common to add solid components to emulsion explosives in the form of glass microspheres for density reduction and prills or particles of oxidizer salt such as porous prilled ammonium nitrate (AN) for increased energy. These solid components, however, tend to destabilize emulsions.

Emulsion explosives commonly are used as a repumpable explosive, i.e., an explosive that is formulated at a remote facility, loaded or pumped into a bulk container and then transported in the container to a blasting site where it then is "repumped" from the container into a borehole. Alternatively, the explosive may be delivered (repumped) into a centrally located storage tank from which it will be further repumped into a vehicle for transportation to a blasting site and then again repumped into the borehole. Thus the emulsion explosive must remain stable even after being subjected to repeated handling or shearing action, which normally also tends to destabilize an emulsion. Additionally, the emulsion's viscosity must remain low enough to allow for repumping at reasonable pressures and at the low ambient temperatures that may be experienced during colder months. Repeated handling or shearing action also tends to increase the emulsion's viscosity.

The advantage of the present invention is that the use of a phenolic derivative emulsifier imparts improved stability and lower viscosity to the emulsion, even after repeated handling or shearing action.

DETAILED DESCRIPTION OF THE INVENTION

The immiscible organic fuel forming the continuous phase of the composition is present in an amount of from about 3% to about 12%, and preferably in an amount of from about 4% to about 8% by weight of the composition. The actual amount used can be varied depending upon the particular immiscible fuel(s) used and upon the presence of other fuels, if any. The immiscible organic fuels can be aliphatic, alicyclic, and/or aromatic and can be saturated and/or unsaturated, so long as they are liquid at the formulation temperature. Preferred fuels include tall oil, mineral oil, waxes, paraffin oils, benzene, toluene, xylenes, mixtures of liquid hydrocarbons generally referred to as petroleum distillates such as gasoline, kerosene and diesel fuels, and vegetable oils such as corn oil, cottonseed oil, peanut oil, and soybean oil. Particularly preferred liquid fuels are mineral oil, No. 2 fuel oil, paraffin waxes, microcrystalline waxes, and mixtures thereof. Aliphatic and aromatic nitrocompounds also can be used. Mixtures of the above can be used. Waxes must be liquid at the formulation temperature.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed below. These additional solid and/or liquid fuels can be added generally in amounts ranging up to 15% by weight. If desired, undissolved oxidizer salt can be added to the composition along with any solid or liquid fuels.

The inorganic oxidizer salt solution forming the discontinuous phase of the explosive generally comprises inorganic oxidizer salt, in an amount from about 45% to about 95% by weight of the total composition, and water and/or water-miscible organic liquids, in an amount of from about 2% to about 30%. The oxidizer salt preferably is primarily ammonium nitrate, but other salts may be used preferably in amounts up to about 20%. The other oxidizer salts are selected from the group consisting of ammonium, alkali and alkaline earth metal nitrates, chlorates and perchlorates. Of these, sodium nitrate (SN) and calcium nitrate (CN) are preferred. From about 10% to about 65% of the total oxidizer salt may be added in particle or prill form.

Water generally is employed in an amount of from about 2% to about 30% by weight based on the total composition. It is preferably employed in an amount of from about 10% to about 20%. Water-miscible organic liquids can partially replace water as a solvent for the salts, and such liquids also function as a fuel for the composition. Moreover, certain organic liquids reduce the crystallization temperature of the oxidizer salts in solution. Miscible liquid fuels can include alcohols such as methyl alcohol, glycols such as ethylene glycols, amides such as formamide, and analogous nitrogen-containing liquids. As is well known in the art, the amount and type of liquid(s) used can vary according to desired physical properties.

The emulsifier of the present invention is a phenolic derivative of polypropene or polybutene, and preferably is used in an amount of from about 0.2% to about 5%. (The terms "polypropene" and "polybutene" shall include polypropylene and polybutylene, respectively.) More specifically, the emulsifier is a polymeric water-in-oil emulsifier having hydrophilic and hydrophobic moieties. The hydrophobic moiety of the emulsifier molecule is polypropene or polybutene, and the hydrophilic moiety can be selected from the group consisting of acid anhydrides, carboxylic acids, amides, esters, amines, alcohols, oxazolines, imides or combinations thereof. The linking group between these moieties is phenol. The terminal olefinic group on polyisobutylene (polybutene), for example, can be reacted with phenol via a Friedel-Crafts alkylation. The hydrophilic moiety or functionality then can be attached to the polyisobutenyl phenol, for example, via a reaction with formaldehyde and a polyamine such as tetraethylene pentamine. The molecular weights of hydrocarbon chains which are useful in the present application may vary from 300 to 3000, but more preferably are from 500 to 1500 g/mole and particularly preferably from 700 to 1300 g/mole.

A particularly preferred phenolic derivative is Amoco 595, a product of Amoco Petroleum Additives Company, which is a polybutene derivatized with a low molecular weight polyethylene polyamine via a phenolic linking group. The active ingredient is diluted to 45% activity with a petroleum distillate.

The emulsifier of the present invention can be used singly or in combination with other emulsifiers such as sorbitan fatty esters, glycol esters, substituted oxazolines, alkyl amines or their salts, other derivatives of polypropene or polybutene, derivatives thereof and the like.

The compositions of the present invention preferably are reduced from their natural densities to within the range of from about 0.9 to about 1.5 g/cc. A preferred density control agent is organic microspheres that preferably are copolymers of vinylidine chloride and acrylonitrile with an isobutane blowing agent. The combination of these organic microspheres and the phenolic derivative emulsifier is particularly advantageous with respect to improved stability and detonation properties and lower viscosities of the final explosive composition. Other density reducing agents that may be used include glass spheres, perlite and chemical gassing agents, such as sodium nitrite, which decomposes chemically in the composition to produce gas bubbles.

One of the main advantages of a water-in-oil explosive over a continuous aqueous phase slurry is that thickening and crosslinking agents are not necessary for stability and water resistancy. However, such agents can be added if desired. The aqueous solution of the composition can be rendered viscous by the addition of one or more thickening agents and cross-linking agents of the type commonly employed in the art.

The explosives of the present invention may be formulated in a conventional manner. Typically, the oxidizer salt(s) first is dissolved in the water (or aqueous solution of water and miscible liquid fuel) at an elevated temperature of from about 25° C. to about 90° C., depending upon the crystallization temperature of the salt solution. The aqueous solution then is added to a solution of the emulsifier and the immiscible liquid organic fuel, which solutions preferably are at the same elevated temperature, and the resulting mixture is stirred with sufficient vigor to invert the phases and produce an emulsion of the aqueous solution in a continuous liquid hydrocarbon fuel phase. Usually this can be accomplished essentially instantaneously with rapid stirring. (The compositions also can be prepared by adding the liquid organic to the aqueous solution.) Stirring should be continued until the formulation is uniform. The solid ingredients, if any, then are added and stirred throughout the formulation by conventional means. The formulation process also can be accomplished in a continuous manner as is known in the art.

It has been found to be advantageous to predissolve the emulsifier in the liquid organic fuel prior to adding the organic fuel to the aqueous solution. This method allows the emulsion to form quickly and with minimum agitation.

Sensitivity and stability of the compositions may be improved slightly by passing them through a high-shear system to break the dispersed phase into even smaller droplets prior to adding the density control agent.

Reference to the following Table further illustrates the invention.

Examples 1, 3, 5, 7, 9, 11 and 13 all contained sorbitan monooleate, a commonly used emulsifier. Corresponding examples 2, 4, 6, 8, 10, 12 and 14, respectively, all contained the phenolic derivative emulsifier of the present invention. After the first week of storage (week 1), each of the examples 2–10 were subjected to a weekly stress test in which a sample was stirred at 1000 rpm for one minute and the degree of crystallization thereafter was observed. In each instance up through Example 10, the even-numbered examples exhibited much more stability (less crystallization) than their odd-numbered couterparts. The even-numbered examples exhibited good stability even in the presence of a common poison (Example 2) and coated prills (Examples 8 and 10). Examples 11–14 were subjected to detonation testing as shown. ("D" is detonation velocity in the given diameter, "MB" is minimum booster in grams of pentolite or number of cap and "dc" is critical diameter.)

The compositions of the present invention can be used in the conventional manner. The compositions normally are loaded directly into boreholes as a bulk product although they can be packaged, such as in cylindrical sausage form or in large diameter shot bags. Thus the compositions can be used both as a bulk and a packaged product. The compositions generally are extrudable and/or pumpable with conventional equipment. The above-described properties of the compositions render then versatile and economically advantageous for many applications.

While the present invention has been described with reference to certain illustrative examples and preferred embodiments, various modifications will be apparent to those skilled in the art and any such modifications are intended to be within the scope of the invention as set forth in the appended claims.

TABLE

| | Mix No: | | | | | | | |
|---|---|---|---|---|---|---|---|---|
| | 1 | 2 | 3 | 4 | 5 | 6 | 7 | 8 |

TABLE-continued

| | | | | | | | | |
|---|---|---|---|---|---|---|---|---|
| Ingredients | | | | | | | | |
| AN | 77.2 | 77.2 | 75.7 | 75.7 | 64.6 | 64.6 | 45.2 | 45.2 |
| SN | | | 4.73 | 4.70 | | | | |
| CN (a) | | | | | 15.1 | 15.2 | 10.6 | 10.6 |
| $H_2O$ | 15.8 | 15.8 | 14.1 | 14.0 | 12.3 | 12.3 | 8.61 | 8.61 |
| Trace Ingred. (b) | 0.047 | 0.047 | | | | | | |
| #2 Fuel Oil | 5.46 | 5.46 | 2.30 | 4.15 | 6.87 | 6.29 | 4.81 | 4.40 |
| Mineral Oil | | | 2.30 | | | | | |
| Emulsifier: | | | | | | | | |
| (c) | 1.54 | | 0.90 | | 1.31 | | 0.92 | |
| (d) | | 1.54 | | 1.35 | | 1.89 | | 1.32 |
| An Prill: | | | | | | | | |
| (e) | | | | | | | 30.0 | 30.0 |
| (f) | | | | | | | | |
| ANFO | | | | | | | | |
| Density Control: (g) | | | | | | | | |
| Density at Storage Temp. | | | | | | | | |
| Storage Temp (°C.) | 20° | 20° | 20° | 20° | 20° | 20° | 20° | 20° |
| Initial Viscosity at Storage Temp (cps) | — | — | 20,840 | 12,640 | 10,160 | 6,600 | — | — |
| Weekly Stress Mixing Rate (rpm) | 1000 | 1000 | 1000 | 1000 | 1000 | 1000 | — | — |
| Degree of Crystallization: | | | | | | | | |
| 1 Week | Heavy | None | Slight | None | None | None | Slight | Slight |
| 2 Weeks | | None | Heavy | Slight | Mod. | Slight | Mod. | Slight |
| 3 Weeks | | Slight | | Slight | Heavy | Slight | Heavy | Slight |
| 4 Weeks | | Slight | | Slight | | Slight | | Mod. |
| 5 Weeks | | | | | | Slight | | Mod. |
| 6 Weeks | | | | | | Slight | | Mod. |
| 7 Weeks | | | | | | Slight | | Heavy |
| 8 Weeks | | | | | | Mod. | | |
| Detonation Results at 5° C. | | | | | | | | |
| D, 75 mm (km/sec) | | | | | | | | |
| MB, 75 mm (Det/Fail) | | | | | | | | |
| dc Det/Fail (mm) | | | | | | | | |
| D, 125 mm (km/sec) | | | | | | | | |
| MB, 125 mm (Det/Fail) | | | | | | | | |
| dc Det/Fail (mm) | | | | | | | | |

| | Mix No: | | | | | |
|---|---|---|---|---|---|---|
| | 9 | 10 | 11 | 12 | 13 | 14 |
| Ingredients | | | | | | |
| AN | 45.2 | 45.2 | 61.9 | 61.9 | 43.3 | 43.3 |
| SN | | | | | | |
| CN (a) | 10.6 | 10.6 | 13.9 | 13.9 | 9.73 | 9.73 |
| $H_2O$ | 8.61 | 8.61 | 16.6 | 16.6 | 11.6 | 11.6 |
| Trace Ingred. (b) | | | | | | |
| #2 Fuel Oil | 4.81 | 4.40 | 4.48 | 3.99 | 3.14 | 2.79 |
| Mineral Oil | | | 1.40 | 1.40 | 0.98 | 0.98 |
| Emulsifier: | | | | | | |
| (c) | 0.92 | | 1.12 | | 0.78 | |
| (d) | | 1.32 | | 1.61 | | 1.13 |
| An Prill: | | | | | | |
| (e) | | | | | | |
| (f) | 30.0 | 30.0 | | | | |
| ANFO | | | | | 30.0 | 30.0 |
| Density Control: (g) | | | 0.60 | 0.60 | 0.42 | 0.42 |
| Density at Storage Temp. | | | 1.17 | 1.15 | 1.24 | 1.20 |
| Storage Temp (°C.) | 20° | 20° | 20° | 20° | 20° | 20° |
| Initial Viscosity at Storage Temp (cps) | — | — | 14,800 | 8,200 | — | — |
| Weekly Stress Mixing Rate (rpm) | — | — | — | — | — | — |
| Degree of Crystallization: | | | | | | |
| 1 Week | Mod. | Slight | | | | |
| 2 Weeks | Heavy | Slight | | | | |
| 3 Weeks | | Slight | | | | |
| 4 Weeks | | Mod. | | | | |
| 5 Weeks | | Mod. | | | | |
| 6 Weeks | | Mod. | | | | |
| 7 Weeks | | Mod. | | | | |
| 8 Weeks | | Heavy | | | | |
| Detonation Results at 5° C. | | | | | | |
| D, 75 mm (km/sec) | | | 5.5 | 5.5 | | |
| MB, 75 mm (Det/Fail) | | | 4.5 g/#12 | 4.5 g/#12 | | |
| dc Det/Fail (mm) | | | 25/— | 32/25 | | |
| D, 125 mm (km/sec) | | | | | 5.3 | 5.1 |
| MB, 125 mm (Det/Fail) | | | | | 9 g/4.5 g | —/— |

TABLE-continued

| | | |
|---|---|---|
| dc Det/Fail (mm) | 75/— | 75/— |

What is claimed is:

1. A water-in-oil emulsion explosive comprising a water-immiscible organic fuel as a continuous phase; an emulsified aqueous inorganic oxidizer salt solution as a discontinuous phase; and a phenolic derivative of polypropene or polybutene as an emulsifier.

2. An explosive according to claim 1 including a density reducing agent in an amount sufficient to reduce the density of the explosive to within the range of from about 1.0 to about 1.5 g/cc.

3. An explosive according to claim 2 wherein the density reducing agent is a copolymer of vinylidine chloride and acrylonitrile.

4. An explosive according to claim 1 wherein the emulsifier is a polyalkylenepolyamine derivative of polybutenyl phenol.

5. A blasting agent according to claim 1 wherein the organic fuel is selected from the group consisting of tall oil, mineral oil, waxes, benzene, toluene, xylene, petroleum distillates such as gasoline, kerosene, and diesel fuels, and vegetable oils such as corn oil, cottonseed oil, peanut oil and soybean oil.

6. An explosive according to claim 1 wherein the inorganic oxidizer salt is selected from the group consisting of ammonium and alkali and alkaline earth metal nitrates, chlorates and perchlorates and mixtures thereof.

7. An explosive according to claim 6 wherein the inorganic oxidizer salt comprises ammonium nitrate in an amount of from about 10% to about 40% by weight.

8. A water-in-oil emulsion explosive comprising a water-immiscible organic fuel as a continuous phase in an amount of from about 3% to about 12% by weight based on the total composition; an emulsified aqueous inorganic oxidizer salt solution as a discontinuous phase, comprising inorganic oxidizer salt in an amount of from about 20% to about 55% and water in an amount of from about 10% to about 20%; particulate oxidizer salt in an amount of from about 35% to about 65%; a phenolic derivative of polypropene or polybutene in an amount of from about 0.1% to about 5% and a density reducing agent in an amount sufficient to reduce the density of the explosive to within the range from about 1.0 to about 1.5 g/cc.

* * * * *